United States Patent [19]

Kafka

[11] Patent Number: 5,076,751

[45] Date of Patent: Dec. 31, 1991

[54] REELROOM NEWSPRINT ROLL HANDLING APPARATUS AND METHOD

[75] Inventor: Alfred J. Kafka, Howell, Mich.

[73] Assignee: Jervis B. Webb Company, Farmington Hills, Mich.

[21] Appl. No.: 498,347

[22] Filed: Mar. 23, 1990

[51] Int. Cl.[5] ..... B65G 1/06

[52] U.S. Cl. ..... 414/282; 414/347; 414/786; 414/911

[58] Field of Search ..... 414/277, 279, 281, 282, 414/283, 910, 911, 347, 786

[56] References Cited

U.S. PATENT DOCUMENTS

| | | | |
|---|---|---|---|
| 3,554,390 | 1/1971 | Saul | 414/277 X |
| 3,746,189 | 7/1973 | Burch et al. | 414/277 X |
| 4,005,786 | 2/1977 | Adelson et al. | 414/281 |
| 4,752,176 | 6/1988 | Linder | 414/279 X |
| 4,863,335 | 9/1989 | Herigstad et al. | 414/911 X |
| 4,971,508 | 11/1990 | Miyahara et al. | 414/282 |
| 4,993,906 | 2/1991 | Nisimura et al. | 414/277 X |

FOREIGN PATENT DOCUMENTS

| | | | |
|---|---|---|---|
| 3734234 | 5/1988 | Fed. Rep. of Germany | 414/281 |
| 8904284 | 5/1989 | World Int. Prop. O. | 414/279 |

*Primary Examiner*—Robert J. Spar
*Assistant Examiner*—James Keenan
*Attorney, Agent, or Firm*—Joseph W. Farley

[57] ABSTRACT

Newsprint roll handling apparatus for a reelroom having a row of reelstands each equipped with spindles adapted to coaxially engage and rotate a cylindrical newsprint roll on a reelstand axis. The apparatus comprises storage racks installed in the reelroom and providing superimposed horizontal rows of storage bins adjacent to the reelstands and extending perpendicular to the reelstand axes, each storage bin being adapted to hold an individual newsprint roll positioned with its axis extending substantially parallel to the reelstand axes. A storage and retrieval machine, mounted for travel along an aisle adjacent to the storage bins and having a vertically and transversely movable roll carrier, is selectively operable to transfer newsprint rolls, delivered to a pickup station at one end of the aisle, from the pickup station either to one of the reelstand load stations provided along the aisle, or to one of the storage bins; and is operable to selectively transfer newsprint rolls from the storage bins to each reelstand load station as required during a press run.

22 Claims, 7 Drawing Sheets

REELROOM NEWSPRINT ROLL HANDLING APPARATUS AND METHOD

SUMMARY OF THE INVENTION

This invention relates to improvements in apparatus for the handling of newsprint rolls in the reelroom of a printing press facility having one or more reelstands requiring the delivery thereto of successive newsprint rolls during a press run. The term "newsprint roll" (or simply "roll") as used herein is intended to denote any roll of paper or other material that may be used in a rotary printing press.

A printing press facility conventionally includes a warehouse area in which a large quantity of newsprint rolls are stored, a reelroom containing the roll receiving spindles of the printing press or presses, and a roll laydown area which is located between the warehouse area and the reelroom. In advance of a press run, a schedule is prepared of the newsprint rolls that will be required, identified by paper type, roll size (full length, three-quarter length or half length) and any other relevant criteria. The corresponding newsprint rolls are then taken from the warehouse area, are transported to the laydown area, and are deposited there in rows with their roll axes horizontal. Newsprint rolls in each row of the laydown area are arranged in an ordered sequence determined by the press run schedule.

An example of such a printing press facility is illustrated in U.S. Pat. No. 4,863,335 showing a multiple reelstand press reelroom and a laydown area having multiple parallel rows each containing a plurality of newsprint rolls arranged in end-to-end axial alignment. During a press run, the newsprint rolls in any laydown area row are removable therefrom only on a first-in first-out basis for delivery to the printing presses. This particular example illustrates self-propelled automatically guided vehicles employed to transport newsprint rolls from the laydown area to the individual reelstands. In each transfer operation, a vehicle travels along a row of newsprint rolls in the laydown area and removes the endmost newsprint roll from the row. No newsprint rolls in the row other than the endmost one are accessible.

Another known type of laydown area employs an inclined deck or platform. Rolls with their axes horizontal are deposited onto the higher side of the deck in parallel rows and move by gravity to the lower side of the deck as the leading roll in each row is successively released and discharged onto conveying equipment for transport to the reelroom. Only the leading rolls can be discharged.

In general, all conventional laydown area arrangements used for marshalling newsprint rolls in newspress facilities require a relatively large amount of floor space because of the number of newsprint rolls needed for a press run. Because of the floor space requirement, the laydown area must be located apart from the press reelroom, thus increasing the transportation time and equipment necessary to deliver rolls from the laydown area to the reelstands. All conventional laydown area arrangements also offer limited access to the rolls contained in the area. Should a roll delivered from the area to a reelstand be there rejected by the operator, the delivery of a replacement roll to that reelstand can become a critical problem in accessing and transporting the required type of replacement roll within the limited time available during a press run.

The present invention provides newsprint roll handling apparatus for a reelroom containing the reelstands of a printing press or presses, the reelstands being normally arranged in a row or in parallel spaced apart rows. Each reelstand includes indexable pairs of arms having spindles adapted to coaxically engage and support, for rotation on a reelstand axis, cylindrical newsprint rolls required to be delivered to the reelstand during the operation of the printing press. The apparatus of the invention comprises newsprint roll storage structure installed in the reelroom and having a plurality of storage bins arranged in a horizontal row, or in superimposed rows, extending substantially perpendicular to the axes of the reelstands. Each storage bin is provided with means for supporting an individual newsprint roll with the axis thereof positioned in substantially parallel axial alignment with the axes of the reelstands.

Mounted for travel longitudinally along an aisle extending adjacent and parallel to the row of storage bins is a storage and retrieval machine having a wheeled base supported on a rail defining the aisle of travel, a vertically movable elevator mounted on the base, a newsprint roll carrier supported by the elevator for movement transversely of the aisle, and drive units for independently moving the base horizontally, the elevator vertically and the roll carrier transversely so that the roll carrier can be moved into and out of any storage bin.

A reelstand load station is located adjacent to each reelstand on the reelstand facing side of the storage structure and the aisle of travel of the storage and retrieval machine, a newsprint roll being transferable between the reelstand load station and the roll carrier of the machine.

Positioned along the aisle of travel of the machine in a desired location accessible to its roll carrier is a pickup station to which newsprint rolls are delivered from a storage area by suitable conveying equipment. The pickup station is equipped with a signalling device for indicating the presence of a newsprint roll thereat. Each reelstand is provided with a signal unit operable to produce newsprint roll delivery and storage request signals.

Control means for regulating the operation of the drive units of the storage and retrieval machine is connected to the pickup station signalling device and to the reelstand signal unit of each reelstand, the control means being operable in response to a newsprint roll present signal from the pickup station signalling device to cause the newsprint roll carrier of the machine to engage a newsprint roll at the pickup station and deposit that engaged roll in a selected one of the storage bins of the storage structure. The control means, in response to a delivery request signal from a reelstand, is also operable to cause the newsprint roll carrier of the machine to transfer a newsprint roll from a selected storage bin to the reelstand load station of that reelstand. Alternatively, the control means may cause the storage and retrieval machine to deliver a newsprint roll from the pickup station directly to a particular reelstand load station; or, in response to a storage request signal from a reelstand signal unit, cause the machine to transfer a newsprint roll from the load station of that reelstand to a selected storage bin.

The control means preferably includes a central processing unit (CPU) capable of not only controlling and monitoring the operation of one or more storage and retrieval machines, but also capable of controlling and monitoring newsprint roll useage as scheduled for a press run so that a newsprint roll of the proper type is delivered to each reelstand in response to each request.

Other features of the newsprint roll handling apparatus of the invention, together with the advantages thereof over the conventional laydown area roll handling techniques mentioned above, will become apparent from the description to follow of the embodiments of the invention shown in the accompanying drawings.

DETAILED DESCRIPTION OF THE INVENTION

Figure 1:
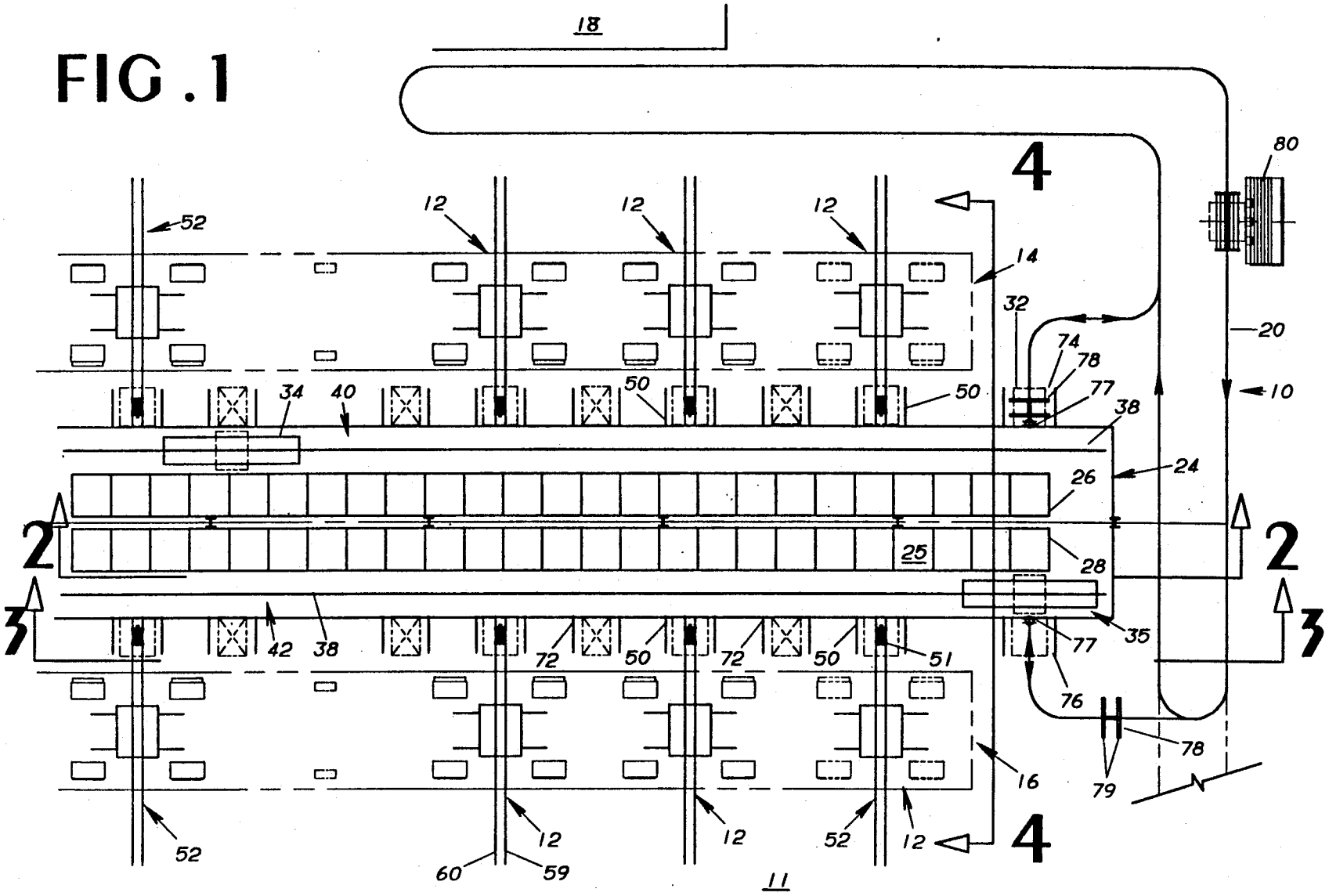
FIG. 1 is a schematic plan view of a representative press reelroom having the newsprint roll handling apparatus of the invention installed therein.
Figure 4:
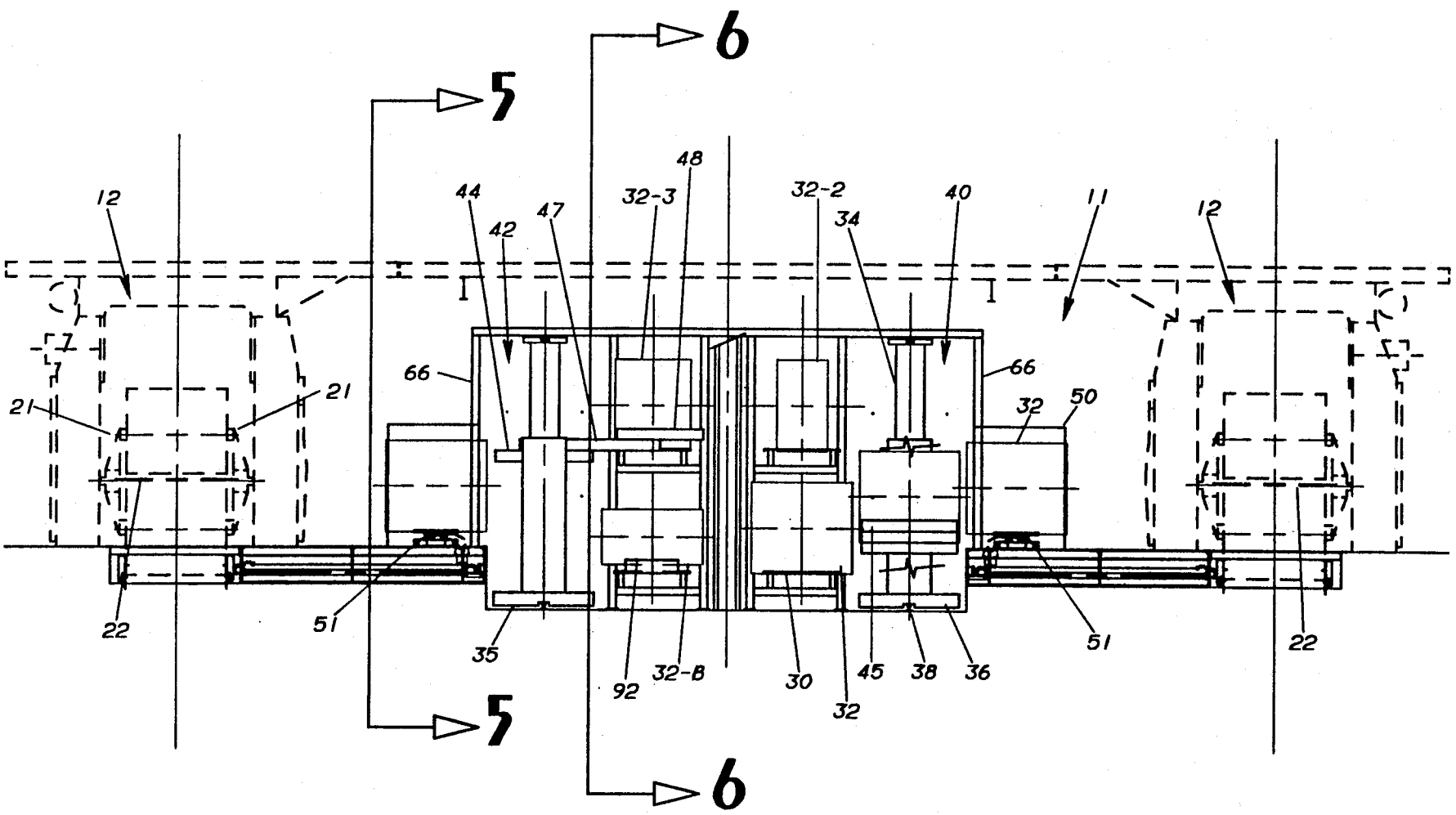
FIG. 4 is an enlarged transverse elevation taken substantially as indicated by the line 4—4 of FIG. 1 showing the newsprint roll handling apparatus in relation to reelstands illustrated in broken line.

FIG. 1 illustrates the newsprint roll handling apparatus 10 of the invention installed in a reelroom 11 of a representative rotary printing press facility containing a plurality of reelstands 12 arranged in two separated parallel rows 14 and 16. Although each of the rows 14 and 16 as shown has four reelstands, this number may vary from one facility to another. The press facility also includes a newsprint roll storage area 18 remote from the reelroom 11 and a suitable form of conveying means 20 for transporting newsprint rolls from the storage area 18 to the reelroom 11 and to the roll handling apparatus 10. Each reelstand 12 is conventional and, as indicated in FIG. 4, has indexable pairs of spider arms 21 with spindles adapted to coaxially engage and support a cylindrical newsprint roll for rotation on a reelstand axis 22.

Figure 2:
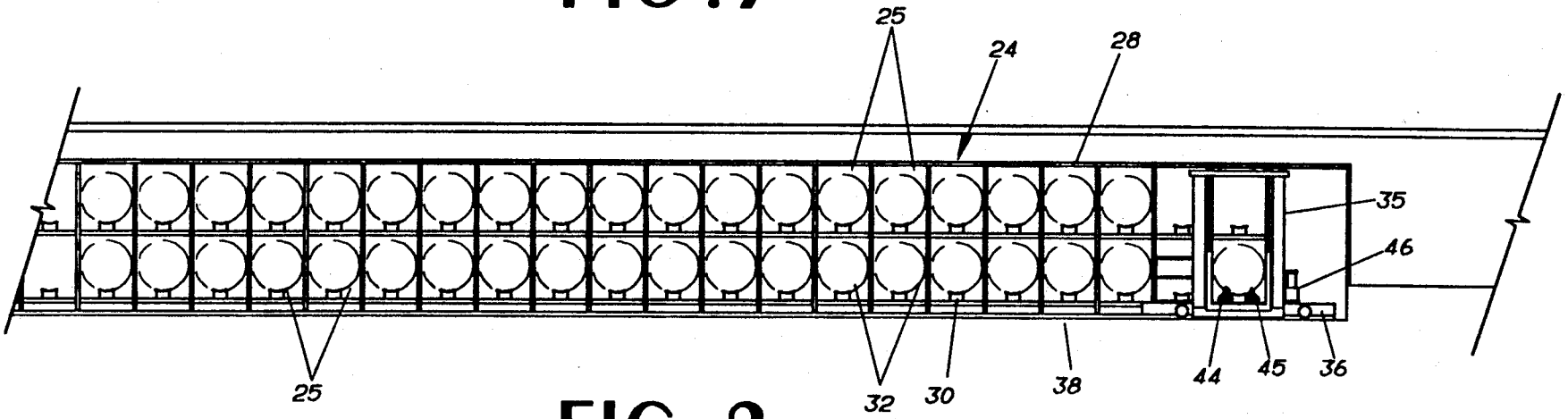
FIG. 2 is a longitudinal elevation taken substantially as indicated by the line 2—2 of FIG. 1 showing a portion of the newsprint roll storage structure.

The newsprint roll handling apparatus 10 comprises newsprint roll storage structure 24 which, as shown in FIGS. 1 and 2, has a plurality of storage bins 25 provided by two parallel, back-to-back racks 26 and 28. Each of the racks 26 and 28 contains a plurality of the storage bins 25 arranged in superimposed horizontal rows extending substantially parallel to the reelstand rows 14 and 16 and perpendicular to the reelstand axes 22. Each storage bin 25 is provided with a cradle or pedestal 30 (FIGS. 2 and 6) for supporting an individual cylindrical newsprint roll 32 with the axis thereof positioned substantially parallel with the axes 22 of the reelstands 12.

Figure 6:
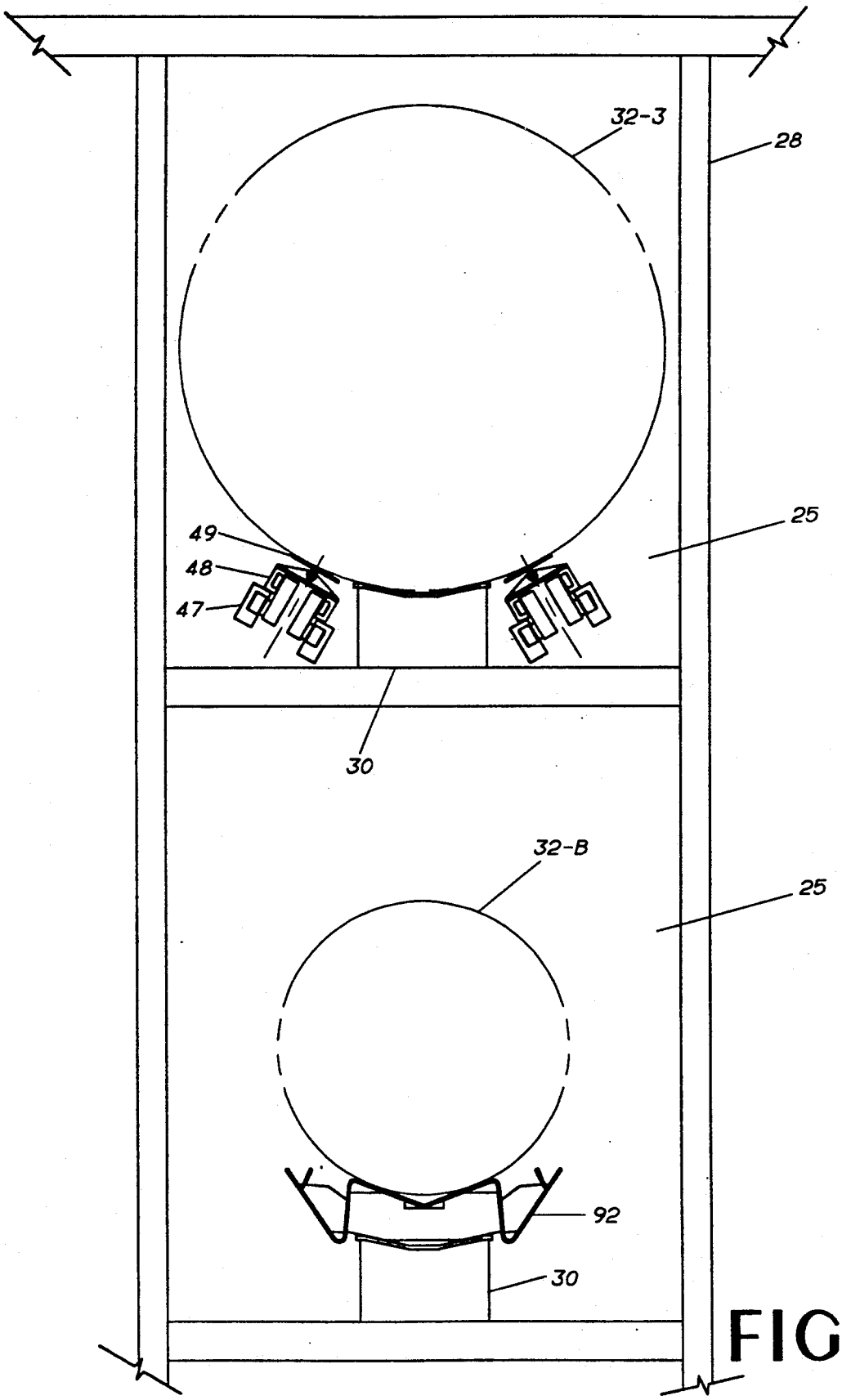
FIG. 6 is an enlarged sectional elevation taken as indicated by the line 6—6 of FIG. 4, showing a portion of the newsprint roll storage structure and handling apparatus.

Storage and retrieval machines 34 and 35 are provided for the storage bin racks 26 and 28 respectively. Each of these machines has a wheeled base 36 mounted for travel longitudinally along a rail 38 which defines an aisle 40 or 42. Each aisle extends adjacent and parallel to one of the racks 26 or 28. The aisle 40 is located at the side of the rack 26 facing the reelstand row 14, and the aisle 42 is located at the side of the rack 28 facing the reelstand row 16. Mounted on the base 36 of each of the machines 34 and 35 is a vertically movable elevator 44, a newsprint roll carrier 45 supported by the elevator for movement transversely of the aisle of travel of the machine, and drive means 46, schematically illustrated in FIG. 2, for independently moving the base 36 horizontally, the elevator 44 vertically and the roll carrier 45 transversely. The roll carrier 45, as shown in FIGS. 4 and 6, is provided with an intermediate and upper pair of obliquely disposed telescoping arms 47 and 48, the upper pair of arms 48 being equipped with pivoted, article engaging pads 49. The arms are transversely movable into a storage bin or any of the other load handling stations to be described, which are located along the aisles of travel 40 and 42 of the storage and retrieval machines, and are adapted to pickup or deposit a load in response to vertical movement of the elevator 44.

The apparatus 10 includes a reelstand load station 50 for each of the reelstands 12. As shown in FIG. 1, each reelstand load station 50 is located adjacent to one of the reelstands 12 and on the side of the storage machine aisle of travel 40 or 42 facing that one reelstand 12. Associated with each load station 50 and its respective reelstand is a newsprint roll shuttle cart 51 movable in a path 52 (indicated by the parallel lines in FIG. 1) that extends parallel to the reelstand axis 22 between a first position at the load station 50 and a second position adjacent to the reelstand spindles.

Figure 5:
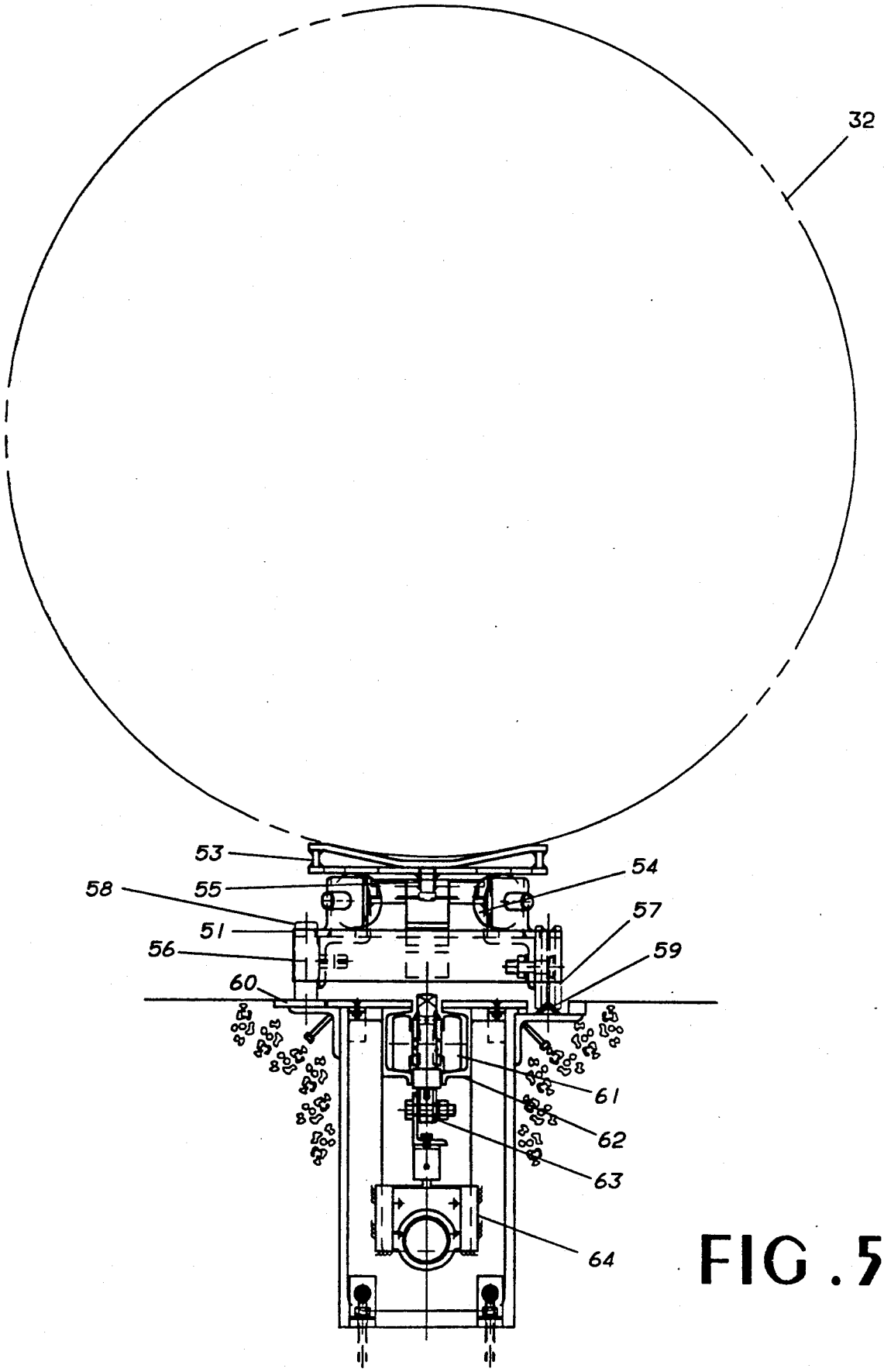
FIG. 5 is an enlarged sectional elevation taken as indicated by the line 5—5 of FIG. 4 showing a newsprint roll shuttle cart.

Each shuttle cart 51, as shown in FIGS. 4 and 5, is adapted to support a newsprint roll 32 in an axially horizontal position on a table 53 rotatable on rollers 54 about a vertical pivot 55. The rollers 54 are mounted on a platform 56 having sets of wheels 57 and 58, the wheels 57 being grooved and Engaging a V-shaped guide rail 59, the wheels 58 being flat and engaging a wear rail 60. Installed below the rails 59 and 60 is a drive trolley assembly 61 which is supported on a track 62, is connected to the shuttle cart platform 56, and is driven by a connection 63 to the output of a linear actuator 64 such as a rodless air cylinder activatable by the reelstand operator through a suitable control device (not shown).

A barrier wall 66 (FIGS. 1, 3 and 4) is preferably installed along the aisles of travel 40 and 42 of the storage and retrieval machines 34 and 35 and at the side of each aisle opposite to the respective storage bin racks 26 and 28. An access opening 67 (FIG. 3) is provided in each barrier wall 66 at each reelstand load station 50; and, each reelstand load station is defined by a pair of vertical partitions 68 extending perpendicularly from the barrier wall at the sides of each access opening 67. The partition pair 68, together with a top cover 69 spanning them, form a protected newsprint roll receiving enclosure at each load station 50.

Waste containers 70 (FIGS. 1 and 3) are provided for the reelstands 12, and waste container transfer stations 72 are located adjacent to the reelstands along the sides of the aisles of travel 40 and 42 facing the reelstands, the waste container transfer stations 72 being spaced longitudinally of the aisles from the reelstand load stations 50. An enclosure 73 is preferably provided at each waste container transfer station 72 and is similar to the previously described enclosure provided at each of the reelstand load stations 50 except that no top cover is provided.

Figure 7:
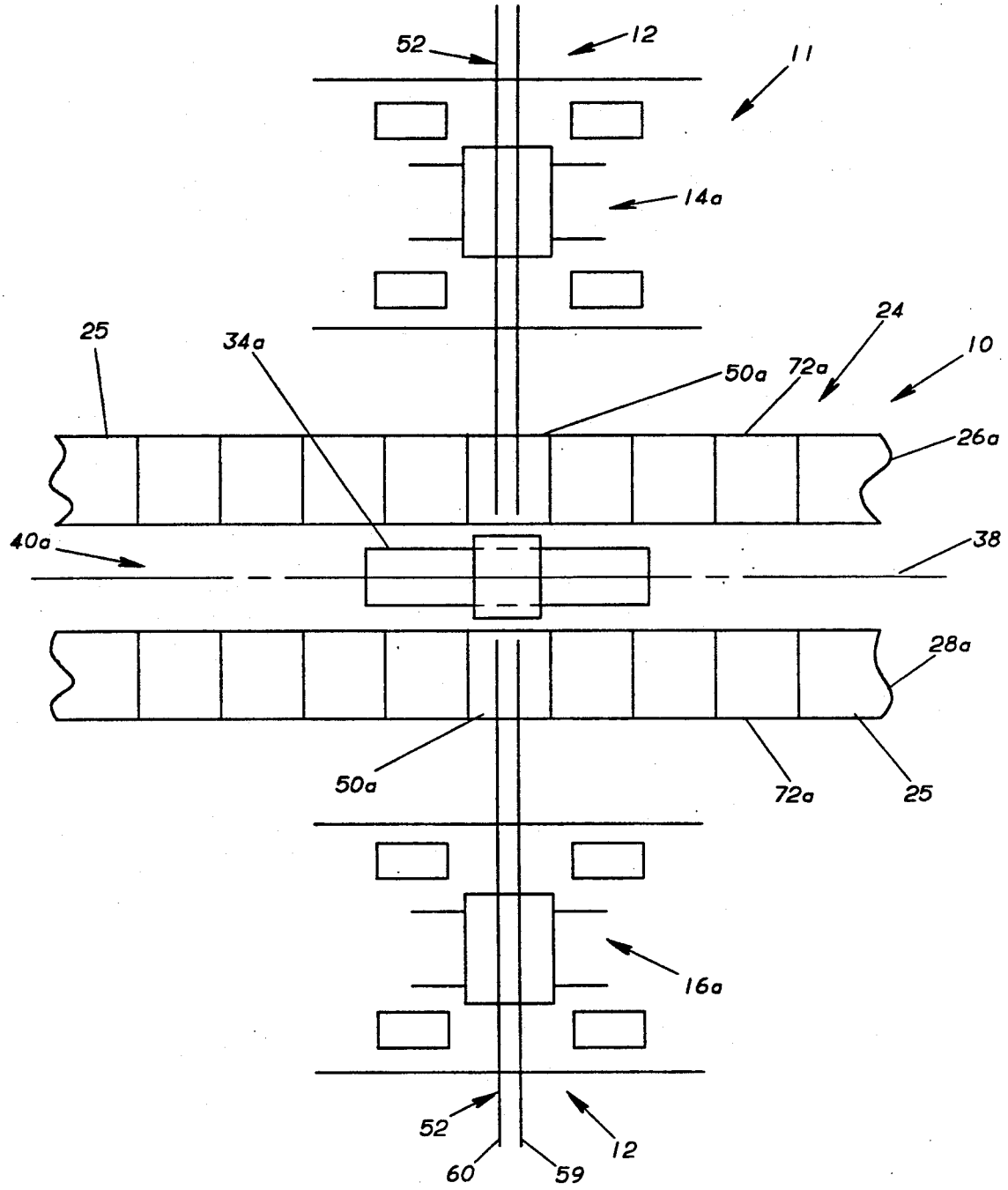
FIG. 7 is a fragmentary schematic plan view showing alternative arrangements of the apparatus of the invention; and, FIG. 8 is a block diagram schematically showing a control system for the apparatus of FIG. 1.

Alternative relationships of the newsprint roll storage structure 24, a storage and retrieval machine 34*a*, and reelstands 12 are shown in FIG. 7. For a reelroom having but one row 14*a* of reelstands 12, the storage structure may comprise either one rack 26*a* of storage bins 25, or parallel racks 26*a* and 28*a* as shown, with the aisle of travel 40*a* of the storage and retrieval machine 34*a* extending intermediate and parallel to the storage bin racks 26*a* and 28*a*, the storage bin rack 26*a* being located adjacent to the reelstand row 14*a*. At the location of each reelstand 12, a storage bin area is dedicated for use as a reelstand load station 50*a* and is equipped with a shuttle cart path of travel 52. Another storage bin area can be used as a waste container transfer station 72*a*. For a reelroom having a second reelstand row 16*a* (as shown in FIG. 7), a reelstand load station 50*a* and a waste container transfer station 72*a* are provided by storage bin areas in the second storage bin rack 28*a*. FIG. 7 illustrates that the newsprint roll storage and handling capabilities of the apparatus 10 of the invention can be varied to suit the requirements and the arrangement of a particular reelroom.

Figure 3:
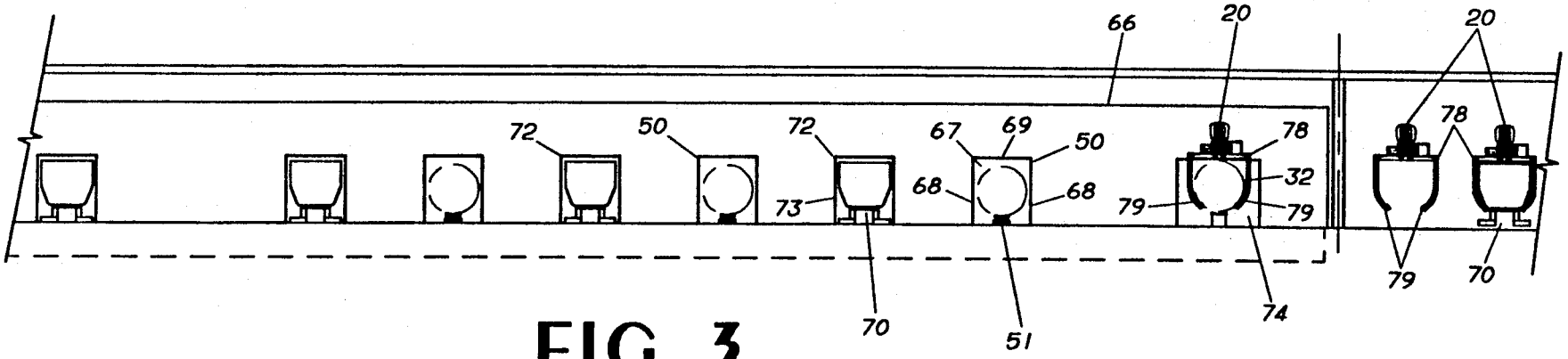
FIG. 3 is a longitudinal elevation taken substantially as indicated by the line 3—3 of FIG. 1 showing a plurality of reelstand load stations for newsprint rolls and trash containers.

Referring to FIGS. 1 and 3, pickup stations 74 and 76 are located adjacent to one end of the aisles of travel 40 and 42, respectively, of the storage and retrieval machines 34 and 35. The delivery conveyor 20 is operable to selectively deliver newsprint rolls 32 to the pickup stations and to deposit each delivered roll at the selected pickup station in a defined axial location relative thereto. Each newsprint roll 32 is delivered to one of the pickup stations 74 and 76 with its cylindrical axis extending horizontally and substantially parallel to the reelstand axes 22. The defined location, mentioned above, is established with respect to the position of longitudinal center of the axis of each newsprint roll, since the axial length of newsprint rolls differs between full, three-quarter, and one-half length rolls. This defined location can be established by roll length sensors at the pickup stations, or by providing at each pickup station 74 and 76 a stop 77 for accurately positioning a conveyor carrier 78 of the conveyor 20, the newsprint roll having been previously loaded on the conveyor carrier 78 in a defined axial position. The defined axial location of each newsprint roll 32 relative to one of the pickup stations establishes the position of each roll relative to all other components of the apparatus 10, namely the roll carrier 45 of each storage and retrieval machine 34 and 35, the storage bins 25, the reelstand load stations 50 and their shuttle carts 51, and the reelstands 12, thus minimizing any longitudinal adjustment required to position each newsprint roll in the reelstand spider arms 21. FIG. 4 illustrates this relative positioning. A full length roll 32, a three-quarter length roll 32-3, and a one-half length roll 32-2 have each been positioned in individual storage bins 25 in the same centered relation relative thereto. That centered relation will be maintained in the subsequent transfer of these rolls to the reelstands.

The delivery conveyor 20 shown is illustrative only of equipment that can be employed for the delivery of newsprint rolls 32 to the pickup stations. The track-supported conveyor carriers 78 are individually self-propelled and reversible; each carrier 78 includes a pair of downwardly extending, vertically movable arms 79 adapted to engage, lift and deposit a load, either a newsprint roll 32 or a waste container 70. A newsprint roll preparation station 80 is located along the path of travel of the delivery conveyor 20 in advance of the pickup stations 74 and 76, and is provided with conventional equipment for removing the protective wrapping from each newsprint roll 32, or at least from the ends thereof.

Figure 8:
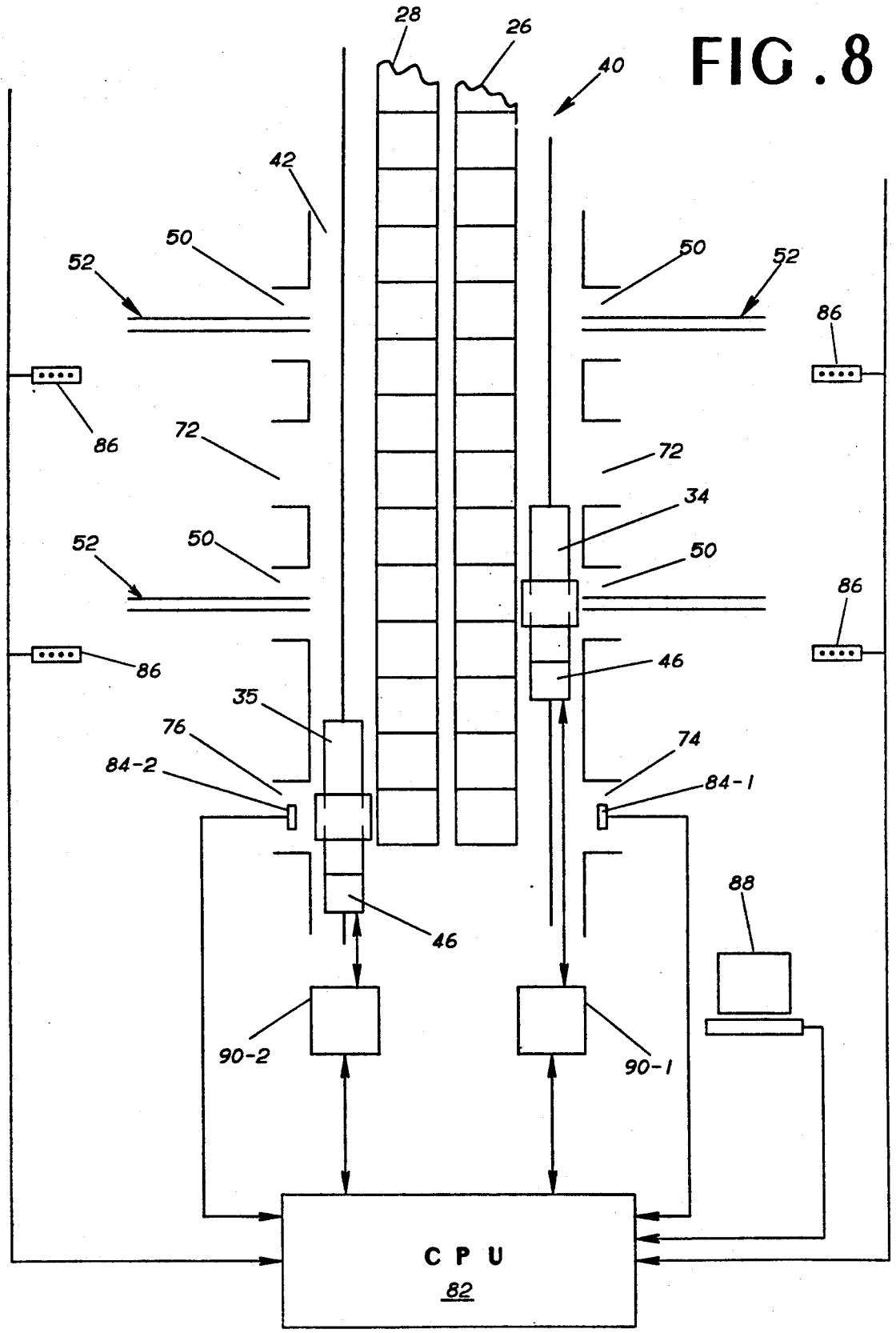

A control system for the apparatus 10 is schematically shown in FIG. 8 and includes a CPU 82 having inputs connected to monitor each of the following signalling devices:

1. Signalling means 84-1 and 84-2 at the pickup stations 74 and 76 for indicating the presence of a newsprint roll thereat.

2. Reelstand signal means 86 at each of the reelstands 12. Each of these reelstand signal means 86 is manually operable to produce any of these request signals:

a. deliver newsprint roll b. store newsprint roll c. remove waste container.

3. An input terminal 88 which is preferably located along the path of travel of the delivery conveyor 20 in advance of the pickup stations 74 and 76, for example at the preparation station 80. This input terminal 88 enables its operator to enter into the CPU 82 any desired data such as the identification of each passing newsprint roll 32, the pickup station 74 or 76 to which it will be delivered, the reelstand at which it will be required, and any other information that may be needed according to the control parameters established for the control system.

Controllers 90-1 and 90-2 are connected to the drive means 46 of the storage and retrieval machines 34 and 35, respectively. Each of these controllers is arranged in two-way communication with the CPU 82. By suitable programming within the skill of the art, the CPU 82 is operable to individually control and monitor the operations of each of the storage and retrieval machines 34 and 35. Each machine 34 or 35, in response to a newsprint roll present signal from the signalling means 84-1 or 84-2 of its respective pickup station 74 or 76, is directed by the CPU 82 to engage the newsprint roll 32 at that pickup station and to either deposit the engaged roll in a selected one of the storage bins in the respective rack 26 or 28, or, to deliver the engaged roll to one of the reelstand load stations along the respective aisle of travel 40 or 42. Likewise, each machine 34 or 35, in response to a request signal from the signal means 86 of a reelstand 12 along the respective aisle of travel 40 or 42 is directed to transfer a newsprint roll 32 between a selected one of the storage bins in the respective racks 26 or 28 and the reelstand load station 50 for that reelstand. In the event that the request signal is a delivery request, the newsprint roll 32 is transferred from the selected storage bin to the reelstand load station 50 of the requesting reelstand. If the request signal is a storage request, the newsprint roll 32 is transferred from the reelstand load station 50 of the requesting reelstand to a selected one of the storage bins 25 in the respective rack 26 or 28. Such a storage request signal can be occasioned either from the rejection by the reelstand operator of a delivered newsprint roll or from the need to remove from the reelstand a partially used, or butt roll 32B, which the operator has taken from the reelstand and placed on a butt roll adapter 92 (FIGS. 4 and 6) engageable by both the newsprint roll carrier 45 of the machine 34 or 35 and by the cradle 30 of the storage bins 25.

In the operation of the apparatus 10, newsprint rolls 32 are taken from the storage area by the delivery conveyor 20 in accordance with the number and type of rolls required by each of the reelstands during a press run, as determined by a roll usage schedule.

Each roll 32, in passing through the preparation station 80, is identified, dispatched to one of the pickup stations 74 or 76 and this information is transmitted to the CPU 82 by the operator at the input terminal 88. Each roll 32 is taken to the designated pickup station 74 or 76 by a conveyor carrier 78, and is there deposited in the defined axial location relative thereto previously described. The thus deposited roll 32 is subsequently removed from the pickup station and delivered to one of the reelstand load stations 50 or stored in a selected bin 25 of one of the storage bins racks 26 or 28 by the appropriate storage and retrieval machine 34 or 35, as directed by the CPU 82. A signal indicating the completion of the directed delivery or storage operation is received and registered by the CPU 82 from the appropriate one of the controllers 90-1 or 90-2. The CPU thus maintains a file containing the location and identity of each newsprint roll received by the apparatus 10.

During a press run, stored rolls 32 are removed from their individual storage bins 25 in the racks 26 and 28 by the respective one of machines as directed by the CPU 82 in response to delivery request signals from the individual reelstands 12. Any delivered roll can be rejected by a reelstand operator, and in response to a remove roll request signal from his reelstand signal means 86 will be taken from the load station 50 for that reelstand by the appropriate machine 34 or 35, returned to storage in one of the bins 25 reserved for rejected rolls, and replaced by another roll 32 of the proper identity, all as directed by the CPU 82.

Wrapping and core waste from rolls 32 delivered to the reelstands is placed by the operators in the waste containers 70 which are then removed by the appropriate one of the machines 34 and 35 from the waste container transfer station 72 of the requesting operator in response to a signal from his reelstand signal unit 86. Removed waste containers 70 are taken to the respective one of the pickup stations 74 and 76 and are there transferable to the carriers 78 of the conveyor 20 for disposal as desired.

Any butt roll 32B either generated during a press run, or remaining at its conclusion, is returnable to storage on a butt roll adapter 92 at the request of a reelstand operator.

From the foregoing description, it can readily be appreciated that in comparison with conventional newsprint roll laydown area practice, the apparatus 10 of the invention offers great savings in the floor space required, and can thereby be installed directly in a reelroom closely adjacent to the reelstands. The time required by the apparatus 10 to deliver a stored roll 32 to a requesting reelstand is accordingly reduced which in turn reduces the amount of conveying equipment necessary. One storage and retrieval machine can replace several automatic guided vehicles or other form of conveyance conventionally used to transport rolls 32 from a laydown area to the reelstands. Moreover, the apparatus 10 of the invention, in addition to these savings in cost and operating time, provides rapid and random access to any newsprint roll 32 contained in any storage bin 25, thereby affording the flexibility to quickly respond to roll storage or delivery problems that may arise in the operation of a reelroom.

I claim:

1. In a printing press reelroom having at least one reelstand requiring the delivery thereto of successive cylindrical newsprint rolls each having an axis, and said reelstand having spindles adapted to coaxially engage and support each such roll for rotation on a reelstand axis, newsprint roll handling apparatus comprising:

newsprint roll storage structure installed in said reelroom, said storage structure having a plurality of storage bins arranged in a row extending substantially perpendicular to said reelstand axis, each storage bin being provided with means for supporting an individual newsprint roll with the axis thereof positioned in substantially parallel axial alignment with said reelstand axis;

a storage and retrieval machine having a base mounted for travel longitudinally along an aisle extending adjacent and parallel to said row of storage bins, a vertically movable elevator mounted on said base, a newsprint roll carrier supported by said elevator, said roll carrier having a pair of arms spaced apart longitudinally of said aisle and movable transversely thereof axially of a newsprint roll, said arms being provided with load engaging means for cradling engagement with surface portions of a load disposed on opposite sides of the longitudinal center thereof, and drive means for independently moving said base horizontally, said elevator vertically, and said roll carrier transversely whereby said roll carrier is movable into and out of a selected one of said storage bins to deposit a newsprint roll therein or to remove a newsprint roll therefrom;

a reelstand load station located adjacent to said reelstand on the side of said aisle of travel of said machine facing said reelstand, a newsprint roll being transferable between said reelstand load station and said roll carrier of said machine;

a pickup station positioned along said aisle of travel of said machine at a desired location accessible by said roll carrier;

signalling means at said pickup station for indicating the presence of a newsprint roll thereat, and signal means at said reelstand operable to produce newsprint roll delivery and storage request signals;

and control means connected to said pickup station signalling means and to said reelstand signal means for regulating the operation of said storage and retrieval machine drive means, said control means being operable in response to a newsprint roll present signal from said pickup station signalling means to cause said newsprint roll carrier of said machine to engage a newsprint roll at said pickup station and deposit such engaged roll in a selected one of said storage bins, and said control means being operable in response to a request signal from said reelstand signal means to cause said newsprint roll carrier of said machine to transfer a newsprint roll between a selected one of said storage bins and said reelstand load station.

2. Newsprint roll handling apparatus according to claim 1 further comprising conveying means for delivering newsprint rolls to said pickup station in a longitudinally defined axial location relative thereto whereby all newsprint rolls engaged by said newsprint roll carrier at said pickup station are deposited in said storage bins in the same relative positional relation therewith.

3. Newsprint roll handling apparatus according to claim 2 wherein said newsprint rolls differ in axial length and said defined axial location is one in which the position of the longitudinal center of each newsprint roll in said pickup station is the same irrespective of its length.

4. Newsprint roll handling apparatus according to claim 2 further comprising a newsprint roll shuttle cart movable in a path parallel to said reelstand axis between a first position at said reelstand load station and a second position adjacent to said reelstand spindles, said newsprint roll carrier of said machine being operable to transfer a newsprint roll between said shuttle cart and a selected one of said storage bins, said first and second positions of said shuttle cart being such that said relative positional relation is maintained between such transferred newsprint roll, said newsprint roll carrier, and said one storage bin.

5. Newsprint roll handling apparatus according to claim 1 further comprising a newsprint roll waste container provided at said reelstand, a waste container transfer station located adjacent to said reelstand on the side of said aisle facing said reelstand and in spaced relation longitudinally of said aisle to said reelstand load station, said newsprint roll carrier of said machine being operable to engage and remove a waste container from said waste container transfer station in response to a command signal from said reelstand signal means.

6. Newsprint roll handling apparatus according to claim 1 further comprising conveying means for delivering newsprint rolls to said pickup station.

7. Newsprint roll handling apparatus according to claim 6 wherein said control means includes an input terminal located along the path of said conveying means in advance of said pickup station, said input terminal being operable to transmit a newsprint roll identification signal to said control means.

8. Newsprint roll handling apparatus according to claim 1 wherein said newsprint roll storage structure is provided with a plurality of horizontal and vertical rows of said storage bins.

9. Newsprint roll handling apparatus according to claim 8 wherein said newsprint roll storage structure is located on the one side of the aisle of travel of said storage and retrieval machine closer to said reelstand, and said reelstand load station is located in one bin of said storage structure.

10. Newsprint roll handling apparatus according to claim 9 wherein said newsprint roll storage structure includes a second row of storage bins arranged in a row extending parallel to said aisle of travel at the side thereof opposite said one side.

11. Newsprint roll handling apparatus according to claim 10, wherein the reelroom includes a second printing press reelstand located adjacent to said second row of storage bins, and a second reelstand load station is located in one bin of said second row of bins.

12. Newsprint roll handling apparatus according to claim 1, wherein the reelroom includes a plurality of reelstands arranged in a row with the axes of all such reelstands parallel, said newsprint roll storage structure extends parallel to and substantially coextensively with said row of reelstands, a reelstand load station is provided for each such reelstand, said aisle of travel of said storage and retrieval machine being arranged intermediate said reelstand load stations and said newsprint roll storage structure and being coextensive therewith, said pickup station is located adjacent to one end of said aisle of travel, a reelstand signal means is provided for each such reelstand, and said control means is selectively responsive to a request signal from each such reelstand signal means.

13. Newsprint roll handling apparatus according to claim 12 wherein a barrier wall is installed along the side of the aisle of travel of said storage and retrieval machine opposite to said newsprint roll storage structure, and an access opening is provided in said barrier wall at each reelstand load station.

14. Newsprint roll handling apparatus according to claim 13 wherein each reelstand load station is in part defined by a pair of parallel partitions extending perpendicularly from said barrier wall at each access opening said partitions forming a protected bay in which a newsprint roll is transferred between the reelstand load station and the newsprint roll carrier of said storage and retrieval machine when projected through said access opening.

15. Newsprint roll handling apparatus according to claim 14 further comprising a newsprint roll shuttle cart movable between a first position within said protected bay and a second position adjacent to the spindles of the reelstand associated with each reelstand load station.

16. Newsprint roll handling apparatus according to claim 1, wherein the reelroom includes a plurality of reelstands arranged in first and second parallel spaced apart rows with the axes of all such reelstands being parallel, said newsprint roll storage structure comprises first and second parallel rows of storage bins located intermediate said reelstand rows, the first and second storage bin rows being respectively substantially coextensive with the first and second reelstand rows, first and second storage and retrieval machines are provided for said first and second rows of storage bins and reelstands respectively, each of said first and second storage and retrieval machines having an aisle of travel extending along its respective row of storage bins and adjacent to its respective row of reelstands, a reelstand load station is provided for each reelstand in said first and second reelstand rows, the reelstand load stations for the first and second reelstand rows being respectively located along the side of the aisle of travel of the first and second storage and retrieval machines opposite to the first and second rows of storage bins, first and second pickup stations are provided, each such pickup station being located adjacent to one end of the aisle of its respective first and second storage and retrieval machine, a pickup signalling means is provided for each pickup station and a reelstand signal means is provided for each reelstand, and said control means is responsive to signals from each pickup signalling means and from each reelstand signal means, said control means being operable to independently regulate the operation of said first and second storage and retrieval machines.

17. Newsprint roll handling apparatus according to claim 16 further comprising conveying means for selectively delivering newsprint rolls to each of said pickup stations.

18. Newsprint roll handling apparatus according to claim 16 further comprising input terminal means connected to said control means for transmitting newsprint roll identification signals thereto, said input terminal means being located along the path of travel of said conveying means in advance of said pickup stations.

19. Newsprint roll handling apparatus according to claim 18 wherein each reelstand signal means includes means for supplying a newsprint roll storage request to said control means.

20. Newsprint roll handling apparatus according to claim 19 wherein said control means includes a CPU having inputs connected to each pickup station signalling means, to each reelstand signal means and to said input terminal means, and a controller for each storage and retrieval machine arranged in two-way communication with said CPU.

21. A method of marshalling and handling newsprint rolls in a reelroom of a printing press having a plurality of reelstands arranged in a row with their axes horizontal and parallel, comprising the steps of:

installing a storage structure in the reelroom for supporting newsprint rolls in individual bins arranged in a row extending in parallel spaced relation with the row of reelstands, providing a newsprint roll load station at the side of the storage structure facing each reelstand, delivering newsprint rolls to the reelroom and using a storage and retrieval machine to selectively place each delivered newsprint roll at one of the reelstand load stations or in one of the storage bins with the newsprint roll axis extending substantially parallel to the reelstand axes, and selectively transferring newsprint rolls individually from the storage bins to the reelstand load stations using the storage and retrieval machine as required by the reelstands during an operation of the printing press.

22. A method according to claim 21 further comprising:

providing in the reelroom a pickup station accessible to the storage and retrieval machine, and wherein said step of delivering newsprint rolls to the reelroom is carried out by the delivery of each newsprint roll to the pickup station in a defined axial location of the delivered newsprint roll relative thereto.

* * * * *